US006167940B1

(12) United States Patent
Lonardi et al.

(10) Patent No.: US 6,167,940 B1
(45) Date of Patent: Jan. 2, 2001

(54) CONTINUOUS CASTING DEVICE

(75) Inventors: Emile Lonardi, Bascharage; Radomir Andonov, Steinfort; Hubert Stomp, Howald; Rudy Petry, Muensbach; Norbert Kaell, Differdange; André Kremer, Leudelange, all of (LU)

(73) Assignee: Paul Wurth, S.A., Luxembourg (LU)

( * ) Notice: Under 35 U.S.C. 154(b), the term of this patent shall be extended for 0 days.

(21) Appl. No.: 09/091,721

(22) PCT Filed: Jan. 9, 1997

(86) PCT No.: PCT/EP97/00049

§ 371 Date: Aug. 19, 1998

§ 102(e) Date: Aug. 19, 1998

(87) PCT Pub. No.: WO97/26099

PCT Pub. Date: Jul. 24, 1997

(30) Foreign Application Priority Data

Jan. 18, 1996 (LU) ..... LU 88 702

(51) Int. Cl.[7] ..... B22D 11/053

(52) U.S. Cl. ..... 164/416; 164/478; 164/418; 164/443

(58) Field of Search ..... 164/418, 416, 164/443, 459, 478, 485

(56) References Cited

U.S. PATENT DOCUMENTS

| | | | |
|---|---|---|---|
| 4,529,031 * | 7/1985 | Scheinecker et al. | 164/416 |
| 4,593,743 | 6/1986 | McVoy et al. | 164/416 |

FOREIGN PATENT DOCUMENTS

| | | |
|---|---|---|
| 2932548A | 3/1980 | (DE) . |
| 0031133A | 7/1981 | (EP) . |
| WO 96/02338 | 2/1996 | (WO) . |

* cited by examiner

*Primary Examiner*—Kuang Y. Lin
(74) *Attorney, Agent, or Firm*—Smith, Gambrell & Russell, LLP

(57) ABSTRACT

The patent describes an oscillating device for a continuous casting mould with a supporting structure (10), an oscillating lever (12), which has a forked first lever arm (30) and a second opposing lever arm (32), this oscillating lever (12) being mounted in the supporting structure by means of first swivel joints (26', 26") so as to be vibratable about an axis (28), and a stroke generator (14), which is connected to the second lever arm (32) of the oscillating lever (12). The oscillating device according to the invention comprises a supporting cage (18) for suspension of a continuous casting mould (20), this supporting cage (18) being connected via second swivel joints (40', 40") to the forked first lever arm (30) of the oscillating lever (12).

19 Claims, 3 Drawing Sheets

CONTINUOUS CASTING DEVICE

FIELD OF THE INVENTION

Figure 1:
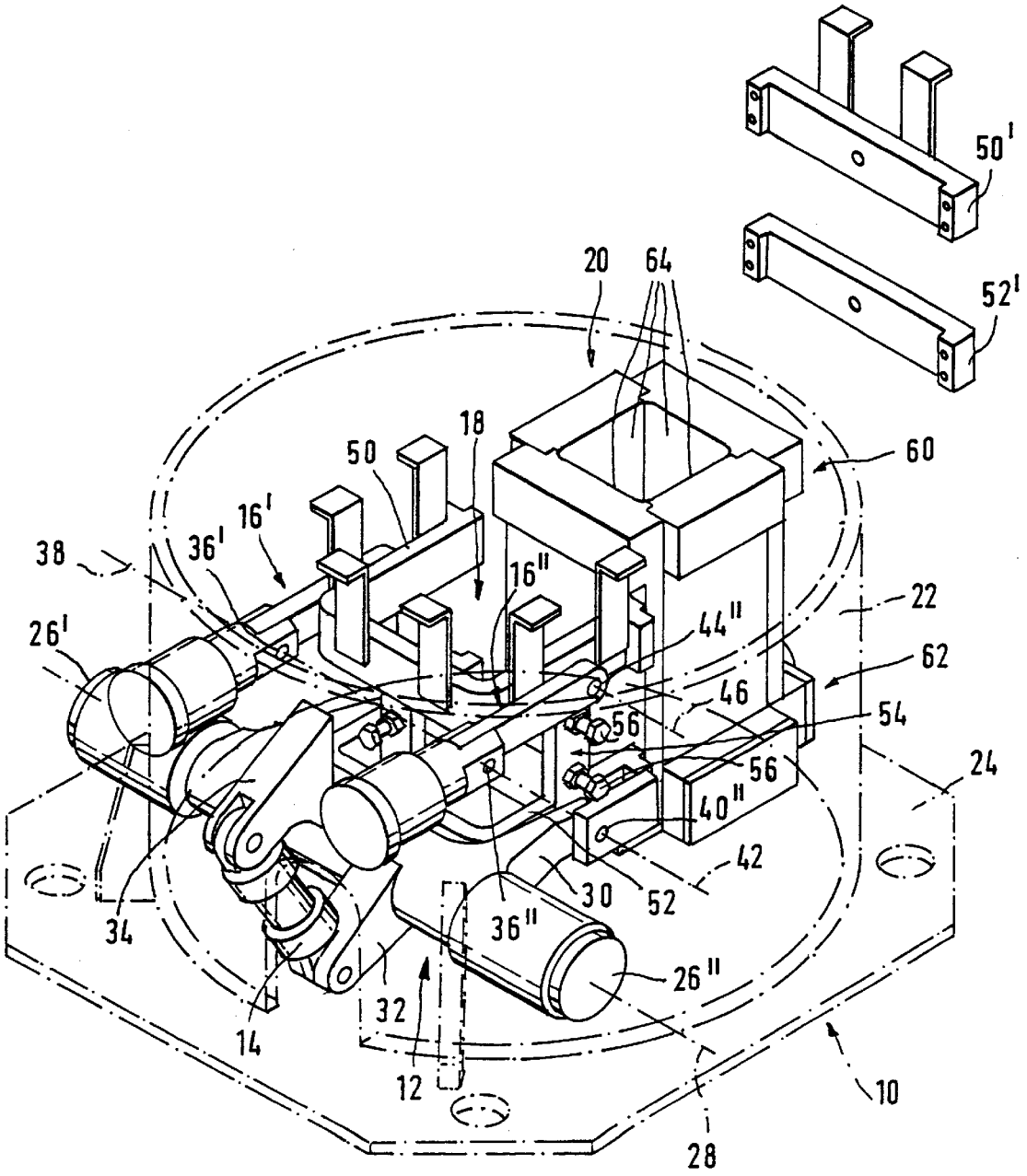

The invention relates to an oscillating device for a continuous casting mould, in particular for the continuous casting of steel.

BACKGROUND OF THE INVENTION

During continuous cast of steel billets the moulds are vibrated in the casting direction to prevent adherence of the billet to the cooled inner walls of the casting tube. These mould vibrations may have a frequency of several Hz and an amplitude of more than 10 mm, for example, the oscillating mass amounting to several tonnes. The vibration of the mould accordingly requires an extremely high power input. It follows that it is desirable to keep the oscillating mass as small as possible.

A conventional oscillating device comprises a lifting table, on which the continuous casting mould is arranged as a unit. These lifting tables have a relatively large mass and also require a large amount of space under the mould, where this space is not always available. A lifting table of this type is described, for example, in EPA0031133.

A lifting table in the form of a horizontal frame is described in DE-A-2932548. This frame is connected on one side via a simple swivel joint to a first angle lever and on the opposite side via a swivel/sliding joint to a second angle lever. The two angle levers are mounted in fixed pivot bearings and connected both to each other and also to the oscillating drive. This lifting table is designed to permit a curved oscillating motion of the mould.

A swivelling device which has an eccentric drive with a lateral jib is known from U.S. Pat. No. 4,593,743. The mould to be vibrated is suspended from the free end of the jib.

The international patent application WO 95/03904 describes a mould which has a fixed casing, to which a casting tube is connected via two flexibly deformable, annular sealing diaphragms in such a way that it can vibrate in the casing along the casting axis. The annular sealing diaphragms seal an annular pressure chamber for a cooling liquid around the casting tube. At its top end the casting tube comprises lateral bearing journals with which it is suspended from an oscillating lever. The latter is pivotable about a horizontal axis in the casing. A lever arm is led out of the pressure chamber through a seal and connected to a lifting cylinder which produces the vibrations. With this mould the mass of the parts to be vibrated and thus the power input is greatly reduced. A disadvantage of this mould is that changing of the casting tube is relatively time-consuming, because the annular sealing diaphragms first have to be dismantled.

The international patent application WO 95/05910 describes a compact oscillating device, which has an annular lifting cylinder, in which a mould consisting of a casting tube and a cooling box can be suspended axially. The mould cooling box is connected to a cooling water circuit via flexible pipe joints. Although the mould can be installed in and removed from this oscillating device relatively easily, the oscillating device is of fairly elaborate design due to the annular lifting cylinder, in particular for moulds with a large cross-section. The present application is based on the task of providing a compact and simple oscillating device, in which the continuous casting mould can be installed and removed relatively easily.

SUMMARY OF THE INVENTION

This problem is solved by an oscillating device according to claim 1.

An oscillating device according to the invention comprises a supporting structure, an oscillating lever with a forked first lever arm as well as a second opposing lever arm, this oscillating lever being pivotable about an axis in the supporting structure by means of first swivel joints, a stroke generator connected to a second arm of the oscillating lever and an oblong supporting cage, into which the continuous casting mould can be placed, one end of this supporting cage being connected via second swivel joints to the forked first arm of the oscillating lever and the other end of this supporting cage guided via at least one guide element in the supporting structure. Hence the continuous casting mould need be suspended only in the supporting cage secured to the oscillating lever and can therefore be installed and removed particularly easily. The oscillating lever with supporting cage is a simple construction, which can also be adapted to moulds with a large cross-section at reasonable cost and occupies little or no space under the mould. The weight of the continuous casting mould can be largely compensated by a counterweight on the second arm of the oscillating lever, so that the stroke generator need not operate against the total weight of the continuous casting mould and can therefore be of relatively small design.

The minimum of one guide is advantageously connected via a first swivel joint to the supporting structure and via a second swivel joint to the supporting cage. If the supporting cage with the continuous casting mould installed is to vibrate along a curved centre line of a curved cast billet, the axes of the swivel joints must be at right angles to a plane which includes the curved centre line, a first straight line intersecting the axes of the swivel joints between the oscillating lever and supporting cage and between the oscillating lever and supporting structure in this plane and a second straight line intersecting the axes of the swivel joints between guide element and supporting cage and between guide element and supporting structure, these axes being positioned in relation to each other in such a way that the first straight line and the second straight line intersect approximately in the centre of curvature of the curved centre line of the cast billet. If the supporting cage is always to remain parallel with itself during vibration, the axes of the swivel joints must be positioned in relation to each other in such a way that the predefined first and second straight lines are parallel with each other.

In the already known oscillating devices flexible hose connections or relatively long pipe compensators were used to supply a coolant to the oscillating device. Flexible hose connections or pipe compensators in the area of the continuous casting device are not unproblematical. There is always a risk of damage due to the high temperatures and metal splashes. Furthermore, they require a large amount of space and offer only low resistance to the oscillating stresses. To replace flexible hose connections and pipe compensators the oscillating lever and/or the guide elements each have at least one coolant duct, which terminates in a pipe connection piece fixed in relation to the supporting structure via a first swivel joint connection in one of the first swivel joints, and in a pipe connection piece fixed in relation to the supporting cage via a second swivel joint connection in one of the second swivel joints. A feed or return pipe of an outer cooling circuit can be rigidly connected to the pipe connection piece fixed in relation to the supporting structure. By contrast a feed or return pipe of an inner cooling circuit of a continuous casting mould can be rigidly connected to the pipe connection piece fixed in relation to the supporting cage.

The supporting cage advantageously comprises a lower and an upper U-shaped frame, which are advantageously connected rigidly to each other. The continuous casting mould can be introduced laterally into this rigid supporting cage, the lower and upper U-shaped frames each being closable by a crossbar.

The supporting cage advantageously comprises lateral pressure devices for play-free centering of the continuous casting mould in the casting axis.

The invention likewise relates to a continuous casting device with an oscillating device as described above. A continuous casting device of this type has, for example, a continuous casting mould with at least one top collector which is designed as a counter-support suitable for the upper U-shaped frame.

The continuous casting mould can be designed as a tubular mould or assembled from mould plates. If the continuous casting mould is assembled from mould plates, the supporting cage improves its mechanical stability.

The above-mentioned mould plates advantageously each have box-shaped upper and lower collectors, which are arranged in such a way that when the continuous casting mould is mounted in the supporting cage the upper collector of the mould plate rests on the upper U-shaped frame and the lower collector extends under the lower U-shaped frame. The lower and upper collectors each advantageously have at least one coolant connection and are connected to each other by cooling ducts in the mould plate. To ensure uniform inflow to these cooling ducts the lower and upper collectors each have a reduced cross-section between the coolant connection and the terminations of the cooling ducts.

If a continuous casting mould comprises several coolant feed or return connections, they are advantageously encircled by at least one feed or return ring main. These ring mains are connected via at least one essentially rigid pipe connection to at least one of the pipe connection pieces fixed in relation to the supporting cage and are connected to the feed or return connections of the continuous casting mould via branch pipes.

Exemplified embodiments of the invention are explained with the aid of the attached drawings.

Figure 2:
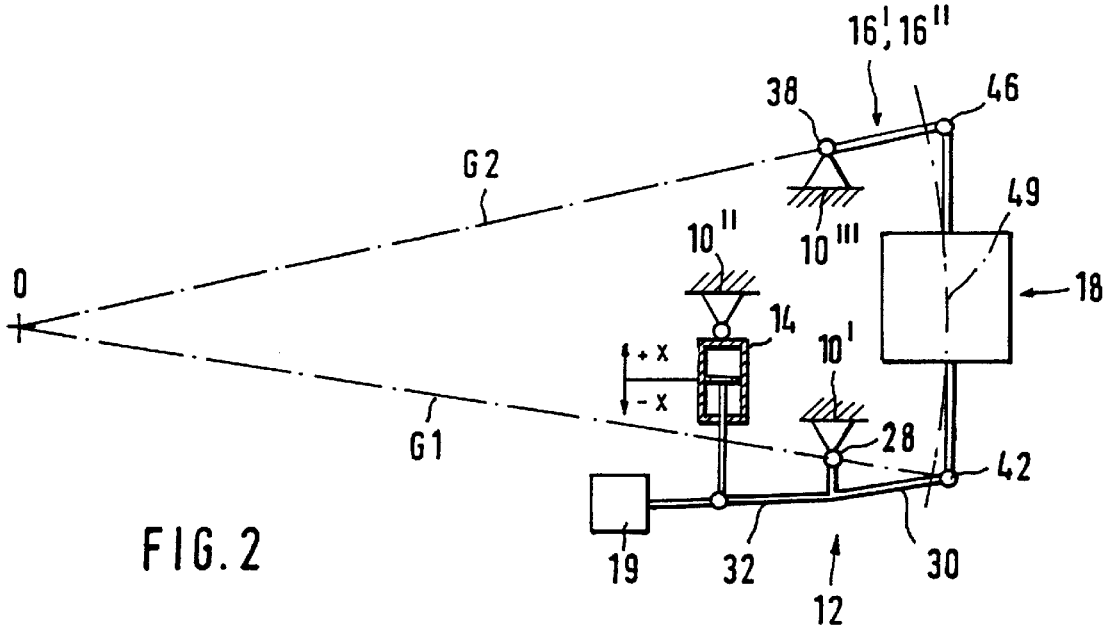
Figure 3:
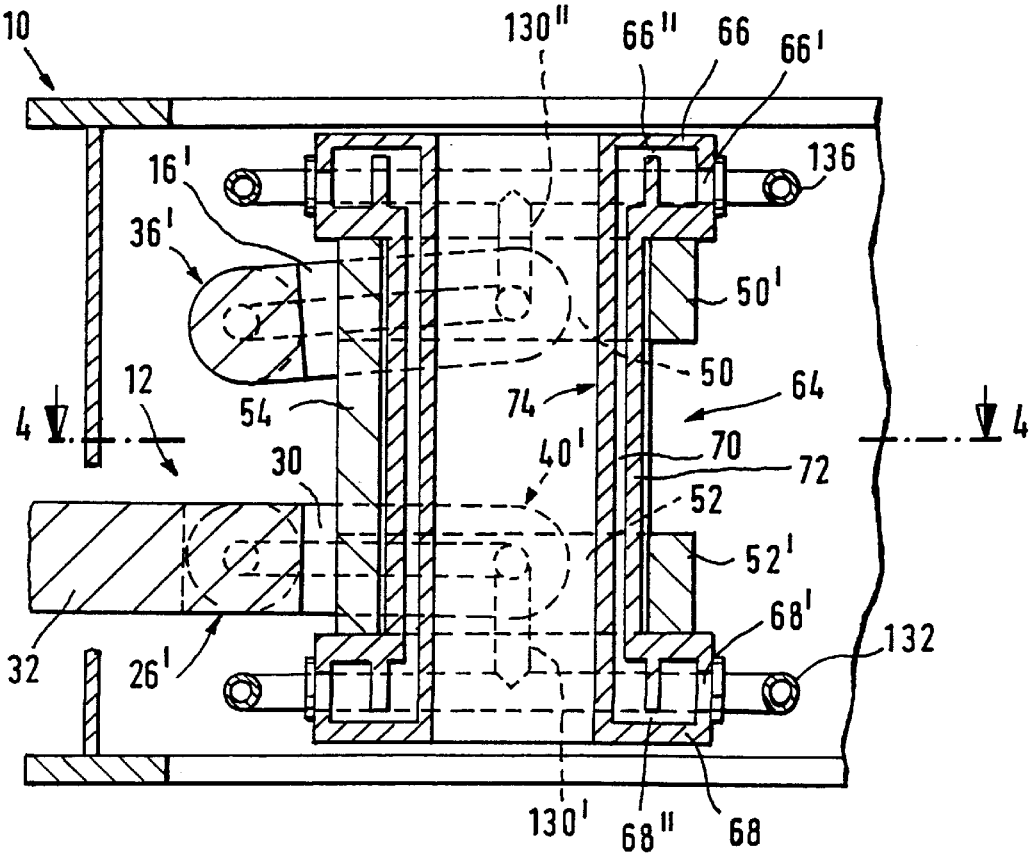
Figure 4:
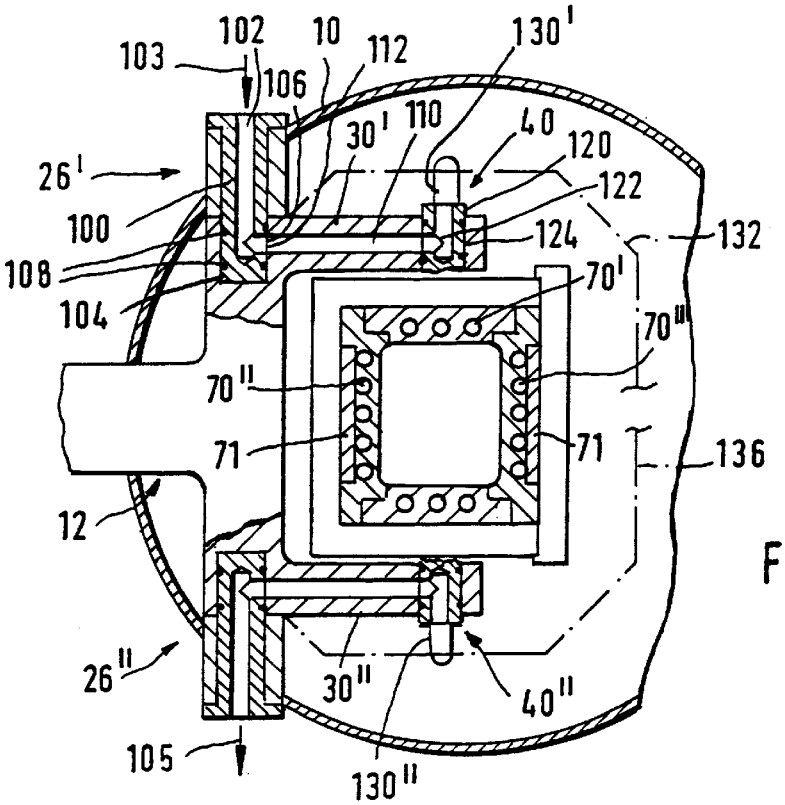
Figure 5:
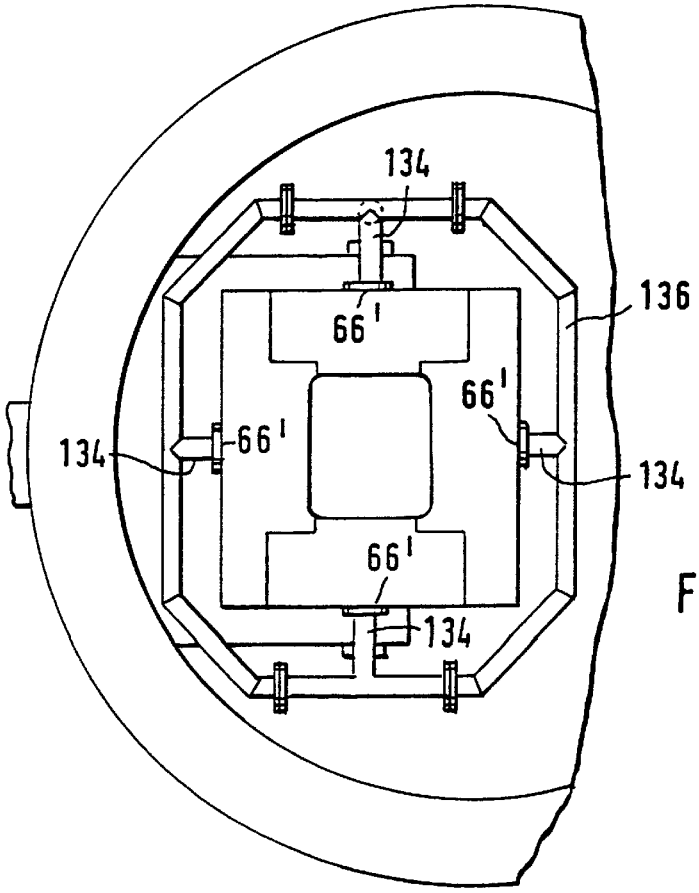

FIG. 1 shows a perspective view of an oscillating device according to the invention with the continuous casting mould removed and the supporting cage open;

FIG. 2 a schematic representation of the oscillating device as a gear;

FIG. 3 a longitudinal section through a continuous casting mould in the supporting cage of an oscillating device according to the invention, the continuous casting mould being connected via an oscillating lever and guide elements to a cooling circuit;

FIG. 4 a cross-section through a continuous casting mould similar to that in FIG. 3, the oscillating lever and its swivel joints likewise being shown partially in section;

FIG. 5 a plan view of the continuous casting device in FIG. 3.

DETAILED DESCRIPTION OF THE DRAWINGS

The oscillating device in FIG. 1 consists essentially of a supporting structure 10 (broken line), an oscillating lever 12, a stroke generator 14, two guide elements 16' and 16" and a supporting cage 18 for a continuous casting mould 20 (shown removed here).

In an advantageous embodiment the supporting structure 10 consists of a cylindrical casing 22 and an assembly plate 24. The oscillating lever 12 is secured in the casing by two swivel joints 26', 26" in such a way that it can vibrate about an essentially horizontal axis 28. It comprises a first forked lever arm 30 and a second opposing one-part lever arm 32. The stroke geherator 14, which is advantageously designed as a hydraulic lifting cylinder, is connected flexibly to the second lever arm 32. This lifting cylinder 14 is likewise flexibly connected to a casing flange 34 and rests via the latter on the supporting structure 10. The two guide elements 16', 16" are likewise secured by two swivel joints 36', 36" in the casing in such a way that they can both vibrate about an essentially horizontal axis 38.

The supporting cage 18 is connected via swivel joints 40', 40" (only swivel joint 40" is visible in FIG. 1) to the oscillating lever 12 in such a way that oscillating lever 12 and supporting cage 18 are rotatable about an axis 42 in relation to each other. The supporting cage 18 is likewise connected via swivel joints 44', 44" (only swivel joint 44" is visible in FIG. 1) to the guide elements 16', 16" in such a way that guide elements 16', 16" and supporting cage 18 are rotatable in relation to each other about an axis 46.

In FIG. 2 the oscillating device is shown in greatly simplified form as a gear, the above-mentioned axes of rotation 28, 38, 42 and 46 all being at right angles to the plane in FIG. 2 and thus shown as points. The supporting structure 10, which encloses the supporting cage as an outer casing, is indicated as fixed points 10', 10" and 10'". The individual moving elements of the gear are the oscillating lever 12 with its two arms 30 and 32, the guide elements 16', 16" and the supporting cage 18. The reference number 19 indicates a counterweight. This counterweight can be attached to the second lever arm 32 to compensate for the weight moment of the support cage 18 with the mould 20 installed acting on the lever 30. The gear drive is shown as a lifting cylinder 14. G1 denotes a straight line which is defined by the points 28, 42, whereas G2 denotes a straight line which is defined by points 38, 46. These straight lines G1 and G2 intersect at a point "○", which corresponds approximately to the centre of an arc 49, which represents the centre line of a curved cast billet. In practice the radius of such a curved cast billet is, for example, about 10 m. If the lifting cylinder 14 is actuated, the supporting cage 18 vibrates, with small vibration amplitudes (in the order of about 10 mm) as a first approximation tangentially to the arc 49. In other words the inclination of the supporting cage 18 in relation to the perpendicular changes as the inclination of the tangent to the arc 49. If, by contrast, the two straight lines G1 and G2 were to be parallel with each other, the oscillating supporting cage 18 would always remain parallel with itself, i.e. vertical in the version shown.

It can be seen in FIG. 1 that the supporting cage essentially comprises an upper U-Frame 50 and a lower U-Frame 52. Both U-frames are connected rigidly to each other via vertical sections 54. The upper U-frame 50 serves as support for a collar type counter-support 60 of the continuous casting mould 20. As indicated in FIG. 1, the continuous casting mould 20 is introduced sideways into the supporting cage 18. A collar-type bottom edge 62 of the continuous casting mould 20 advantageously extends under the lower U-frame 52. After the continuous casting mould 20 has been suspended in the supporting cage 18, the two U-frames 50 and 52 are closed by crossbars 50', 52'. Pressure devices, e.g. bolts 56, are advantageously arranged on all four sides of the supporting cage 18 in such a way that they rest on the supporting cage and on the continuous casting mould 20 to permit play-free centering of the continuous casting mould 20 in the supporting cage 18.

The continuous casting mould 20 can be designed as a tubular or plate mould for casting the most diverse products, e.g. billets, beam blanks, slabs, thin slabs, etc. The figures show a particularly advantageous embodiment of a plate mould for the oscillating device. This plate mould is assembled from four mould plates 64, which form a runner with an essentially rectangular or square cross-section. FIG. 3 shows a longitudinal section through two of these mould plates 64. A mould plate 64 of this type comprises a top and bottom box-shaped collector 66 and 68, which are designed in such a way that they form the upper collar-type counter-support 60 or the lower collar-type edge 62 of the continuous casting mould 20 when the latter is assembled. Each of the collectors 66 and 68 has a connection 66' or 68' for a coolant pipe. The coolant flows, for example, through the connection 68' into the bottom collector 68, where it is led through a reduced cross-section 68" into cooling ducts 70. The latter traverse the body 72 of the mould plate 64, which may consist, for example, of pure copper or a copper alloy, before they terminate in the top collector 66 via a reduced cross-section 66". The cooling ducts 70 are arranged in the body 72 of the mould plate 64 in such a way that satisfactory cooling of the surface 74 of the mould plate 64 in the runner is ensured. In the lateral mould plates of the chill mould according to FIG. 4 (i.e. in the mould plates, which form a flat cooling surface on the side of the runner) the cooling ducts 70' are designed, for example, as holes or integrally cast ducts in the body 72 of the mould plate 64. In the front and rear mould plate of the mould according to FIG. 4 (i.e. in the two mould plates, which advantageously form a curved cooling surface, which corresponds to the curvature of the cast billet), the cooling ducts 70" are advantageously cut into the body 72 and closed by a welded-on plate 71. The cooling ducts 70" cut in are a constant distance behind the curved cooling surface. A cooling space, which is advantageously subdivided by fins into cooling ducts, can, of course also be arranged behind the cooling surface. In this case the mould plate is advantageously assembled from two halves like a sandwich.

The continuous casting mould suspended in the supporting cage could, of course, be supplied in a known way with a coolant via flexible lines. However, a far more advantageous solution for supply of a coolant to the continuous casting mould in an oscillating device according to the invention is described with the aid of FIGS. 4 and 5. According to this solution the continuous casting mould is supplied with a coolant via the four swivel joints 26', 26", 40', 40" and the two arms 30', 30" of the oscillating lever 12. The swivel joint 26' comprises for this purpose a cylindrical supporting journal 100 with an axial blind hole 102, which is secured non-rotatably on the supporting structure 10. The supporting journal 100 is introduced into a bearing hole 104 of the oscillating lever 12. In the bearing hole 104 the axial blind hole 102 forms a radial outlet 106. A duct 110 in the arm 30' of the oscillating lever 12 likewise forms an outlet 112 opposite the outlet 106. Both outlets 106 and 112 are designed in such a way that they always overlap sufficiently when the oscillating lever 12 is rotated about the supporting journal 100 to ensure satisfactory transfer of the cooling medium. The radial play of the supporting journal 100 in the bearing hole 104 is axially sealed by O-rings 108 or other sealing means.

The swivel joint 40" is of similar construction. A cylindrical supporting journal 120 with an axial blind hole 122 is connected non-rotatably to the supporting cage 18. This supporting journal 120 is introduced into a bearing hole 124 of the arm 30' of the oscillating lever 12. As already described, blind hole 122 is connected to the duct 110 in the arm 30' of the oscillating lever 12 via outlets overlapping in the bearing hole 124.

The coolant can now be introduced into the axial hole 102 via a pipe connection piece (indicated schematically by arrow 103) connected to the fixed bearing journal 102. From here it can pass into the duct 110, through the latter into the swivel joint 40', then into the blind hole 122 of the journal 120 and through the blind hole 122 into a pipe connected to the journal 102. This pipe connection 130' vibratable with the supporting cage 18 terminates in a ring main 132, which is connected by branch pipes 134 (see FIG. 5) to the individual connections 68' of the lower collector 68 of the continuous casting mould.

The second arm 30" of the oscillating lever 12 with the swivel joints 26" and 40" can then be designed as a connection of the top collector 66 of the continuous casting mould to a fixed return pipe for the coolant (indicated schematically by arrow 105), as shown in FIG. 4. For this purpose a second ring main 136 is connected via branch pipes 134 (see FIG. 5) to the individual connections 66' of the top collector 66 of the continuous casting mould 20. A rigid pipe connection 130" connects this second ring main 136 rigidly to the journal of the swivel joint 40" (hence the second ring main 136 can likewise be rotated with the mould (20). The coolant passes from the swivel joint 40" into the second lever arm 30" and via the latter into the swivel joint 26", where it enters the fixed return pipe 105.

Alternatively both arms 30' and 30" of the oscillating lever 12 can be used for the coolant feed. In this case the two guide elements 16', 16" with their swivel joints 36', 36", 44', 44" are advantageously designed as a return connection for the coolant, as indicated in FIG. 3.

It should also be noted that for easier installation of an electromagnetic agitator (not shown) the oscillating lever 12 is advantageously connected to the bottom end of the supporting cage 18 and the guide elements 16', 16" are advantageously connected to the top end of the supporting cage 18. The guide elements 16', 16" can then advantageously be folded upwards from the supporting structure 10, so that the coil of the electromagnetic agitator can easily be inserted from above without dismantling the oscillating lever 12, the guide elements 16', 16" or the supporting cage 18.

What is claimed is:

1. Continuous casting device comprising:

a supporting structure;

an oscillating lever with a forked first lever ann and a second opposing lever arm;

first swivel joints connecting said oscillating lever to said supporting structure, so that said oscillating lever can be oscillated about an axis, a stroke generator connected to said second lever ann of said oscillating lever;

a continuous casting mould;

a supporting cage in which said continuous casting mould is inserted, said supporting cage having a first and a second end that are vertically spaced from one another, second swivel joints connecting said forked first lever arm of said oscillating lever to said first end of said supporting cage, and at least one guide element for guiding said second end of said supporting cage in said supporting structure.

2. The device according to claim 1, wherein said at least one guide element is connected via a first swivel joint to said supporting structure and via a second swivel joint to said supporting cage.

3. The device according to claim 1, wherein said supporting structure is designed as a casing that encloses said supporting cage.

4. The device according to claim 2, for casting a billet along a curved centre line in a vertical plane, wherein the axes of the swivel joints are arranged so that:

each of said axes is perpendicular to the vertical plane which contains said curved centre line; and said axes define a first straight line intersecting in said plane the axes of said swivel joints connecting said oscillating lever to said supporting cage and said oscillating lever to said supporting structure, and a second straight line intersecting in said plane said axes of said swivel joints connecting said guide element to said supporting cage and said guide element to said supporting structure, wherein said first straight line and said second straight line intersect approximately in the centre of curvature of said curved centre line.

5. The device according to claim 1, including:

a first pipe connection fixed in relation to said supporting structure;

a second pipe connection fixed in relation to said supporting cage;

at least one duct for a coolant in said oscillating lever;

a first swivel joint connection in one of said first swivel joints of said oscillating lever, said first swivel joint connection connecting said first pipe connection to said at least one duct; and a second swivel joint connection in one of said second swivel joints of said oscillating lever, said second swivel joint connection connecting said second pipe connection to said at least one duct.

6. The device according to claim 2, including:

a first pipe connection fixed in relation to said supporting structure;

a second pipe connection fixed in relation to said supporting cage;

at least one duct for a coolant in said guide element;

a first swivel joint connection in one of said first swivel joints of said guide element, said first swivel joint connection connecting said first pipe connection to said at least one duct; and a second swivel joint connection in one of said second swivel joints of said guide element, said second swivel joint connection connecting said second pipe connection to said at least one duct.

7. The device according to claim 1, wherein said supporting cage comprises a lower U-shaped frame and an upper U-shaped frame receiving said continuous casting mould.

8. The device according to claim 7, wherein said lower and upper U-shaped frames are closed by a removable crossbar.

9. The device according to claim 7, characterized in that said lower and upper U-shaped frames are rigidly connected to each other.

10. The device according to claim 9, wherein said continuous casting mould has at least one top collector designed as a counter support for said upper U-shaped frame.

11. The device according to claim 10, wherein said continuous casting mould is assembled from mould plates.

12. The device according to claim 11, wherein at least one mould plate has box-shaped top and bottom collectors, which are arranged in such a way that said top collector rests on said upper U-shaped frame and said bottom collector extends under said lower U-shaped frame when said continuous casting mould is mounted in said supporting cage.

13. The device according to claim 12, wherein said bottom and top collectors each have a coolant connection and said mould plate has inner cooling ducts, which interconnect said top and bottom collectors.

14. The device according to claim 13, wherein each of said bottom and top collectors has outlet openings of said inner cooling ducts and a reduced cross-section between said coolant connection and said outlets openings of said inner cooling ducts.

15. The device according to claim 5, wherein said continuous casting mould has at least one top or bottom collector, which is connected via at least one essentially rigid pipe, to one of said pipe connections fixed in relation to said supporting cage.

16. The device according to claim 15, wherein said continuous casting mould has several cooling water feed connections, said device further comprising:

a feed ring main oscillated with said mould, said feed ring main surrounding said continuous casting mould and being rigidly connected to a pipe connection fixed in relation to said supporting cage, and branch pipes which connect said feed ring main to said cooling water feed connections.

17. The device according to claim 6, wherein said continuous casting mould has at least one top or bottom collector, which is connected via at least one essentially rigid pipe, to one of said pipe connections fixed in relation to said supporting cage.

18. The device according to claim 17, wherein said continuous casting mould has several cooling water feed connections, said device further comprising:

a feed ring, main oscillated with said mould, said feed ring main surrounding said continuous casting mould and being rigidly connected to a pipe connection fixed in relation to said supporting cage, and branch pipes which connect said feed ring main to said cooling water feed connections.

19. A device according to claim 1, comprising adjustable centring devices laterally arranged in said supporting cage for centring said continuous casting mould therein.

* * * * *